US006545595B1

(12) United States Patent
Xydis

(10) Patent No.: US 6,545,595 B1
(45) Date of Patent: Apr. 8, 2003

(54) CD QUALITY WIRELESS DOOR CHIME

(75) Inventor: Thomas G. Xydis, Ann Arbor, MI (US)

(73) Assignee: The Lamson & Sessions Co., Cleveland, OH (US)

( * ) Notice: Subject to any disclaimer, the term of this patent is extended or adjusted under 35 U.S.C. 154(b) by 0 days.

(21) Appl. No.: 09/668,191

(22) Filed: Sep. 22, 2000

Related U.S. Application Data

(62) Division of application No. 09/130,042, filed on Aug. 6, 1998, now Pat. No. 6,175,298.

(60) Provisional application No. 60/055,236, filed on Aug. 11, 1997.

(51) Int. Cl.[7] ..... G08B 3/00

(52) U.S. Cl. ..... 340/392.1; 340/384.1; 340/384.5; 340/328; 381/61

(58) Field of Search ..... 340/392.1, 384.1, 340/384.5, 328, 384.3, 384.4; 381/17, 61, 124, 118

(56) References Cited

U.S. PATENT DOCUMENTS

| | | | | |
|---|---|---|---|---|
| 4,110,750 A | | 8/1978 | Heyning et al. | |
| 4,236,147 A | | 11/1980 | Calvin | |
| 4,326,276 A | | 4/1982 | Scott, Jr. | |
| 4,488,272 A | | 12/1984 | Scott, Jr. | |
| 4,523,193 A | | 6/1985 | Levinson et al. | |
| 4,833,454 A | | 5/1989 | Pawlik et al. | |
| 4,991,218 A | | 2/1991 | Kramer | |
| 5,008,859 A | * | 4/1991 | Cyr | 367/2 |
| 5,210,520 A | | 5/1993 | Housley | |
| 5,337,363 A | | 8/1994 | Platt | |
| 5,355,513 A | * | 10/1994 | Clarke et al. | 340/870.02 |
| 5,365,214 A | * | 11/1994 | Angott et al. | 340/328 |
| 5,475,369 A | | 12/1995 | Baker | |
| 5,576,690 A | * | 11/1996 | Waugh et al. | 340/521 |
| 5,604,478 A | * | 2/1997 | Grady et al. | 119/174 |
| 5,638,047 A | * | 6/1997 | Orloff et al. | 340/328 |
| 5,748,074 A | * | 5/1998 | Chomet | 340/328 |
| 5,774,039 A | | 6/1998 | Housley | |
| 5,774,567 A | | 6/1998 | Heyl | |
| 5,801,757 A | | 9/1998 | Saulsbury | |
| 6,166,660 A | * | 12/2000 | Grenier | 340/515 |
| 6,175,298 B1 | * | 1/2001 | Xydis | 340/328 |

* cited by examiner

*Primary Examiner*—Nina Tong
(74) *Attorney, Agent, or Firm*—Jones Day

(57) ABSTRACT

A doorbell system having a sound memory for storing and playing a CD quality doorbell sound is disclosed. Said doorbell system includes a receiver unit for receiving an indication of a doorbell button being pressed, a code detector for commanding the sound memory to output stored sound signals and sound producing means for outputting a CD quality sound. Also disclosed is a method for storing a CD quality sound into a doorbell system.

18 Claims, 6 Drawing Sheets

CD QUALITY WIRELESS DOOR CHIME

This Application is a divisional of Ser. No. 09/130,042 filed Aug. 6, 1998, now U.S. Pat. No. 6,175,298, which claims benefit of Ser. No. 60/055,236 filed Aug. 11, 1997.

BACKGROUND OF THE INVENTION

The present invention is directed toward the field of door chimes. In particular, a door chime system that uses a high quality recorded sound to indicate the activation of a door chime button is disclosed. The invention provides the distinct advantage over the prior art of playing a CD quality recorded musical doorbell indication sound instead of an artificial sound produced by an electronic music synthesizer chip.

The invention may be incorporated into any wireless door chime. U.S. Pat. No. 5,365,214, assigned to Dimango and hereby incorporated by reference, for example, discloses a door chime having multiple detectors which transmit radio frequency ("RF") signals to a common receiver upon the depression of doorbell buttons. Each detectors is associated with a specific doorbell button and includes means for allowing manual selection of a song or melody to be played by the receiver upon the receiver's receipt of the RF signal from the detector. The system allows different audible indications to be played in response to the depression of the doorbell button associated with a particular detector. As a result, a user can program each detector, such as a front doorbell detector and a back door detector, to signal, through its RF signal, the receiver to play a distinct audible indication whenever a specific doorbell button is pressed so that a user can determine from the audible indication played by the receiver which doorbell button was pressed.

A particular shortcoming of many of the wireless door chime systems, such as the system described above, is the sound quality of the audible indication. Typical door chime systems produce a poor quality sound. Therefore, there remains a need in this art for a method of creating a high sound quality signal for use with door chime systems. There remain a more particular need for a method of storing a CD quality sound into a door chime system. There also remains a need for a door chime system capable of playing a CD quality sound.

SUMMARY OF THE INVENTION

The present invention overcomes the problems noted above and satisfies the needs in this field for a method and apparatus for recording a CD quality digital sound for use in a door chime system. In one embodiment the method of recording and storing a CD quality sound for use in a door chime system includes the steps of providing a first sound, digitizing the first sound, filtering the digitized sound signal, converting the filtered digitized sound signal into a second sound, and storing the second sound into memory in the door chime system.

The present invention also provides a door chime system that is capable of storing and playing a CD quality sound that has been recorded according to the method disclosed herein. In one embodiment, a door chime system includes a door chime detector which sends a signals whenever it detects the activation of a doorbell button; a receiver which receives the signal from the door chime detector, the receiver including circuitry which outputs data sent from said door chime detector; a code detector having an input which receives data output from the receiver, the code detector determining whether a door chime sound is to be played as a result of receiving the signal from the door chime detector, the code detector providing a command to play the high quality sound; a sound memory having an input which receives a command from said code detector and outputs a signal representing a high quality sound upon receipt of said command; and sound producing means for converting the high quality sound signals from the sound memory into an audible sound.

In another embodiment, the system includes wake-up circuitry for switching the system from a sleep state to an active state.

As will be appreciated, the invention is capable of other and different embodiments, and its several details are capable of modifications in various respect, all without departing from the spirit of the invention. Accordingly, the drawings and description of the preferred embodiment are to be regarded as illustrative in nature and not restrictive.

BRIEF DESCRIPTION OF THE DRAWINGS

The present invention satisfies the needs noted above as will become apparent from the following description when read in conjunction with the accompanying drawings wherein.

DETAILED DESCRIPTION OF THE PREFERRED EMBODIMENT

Figure 2:
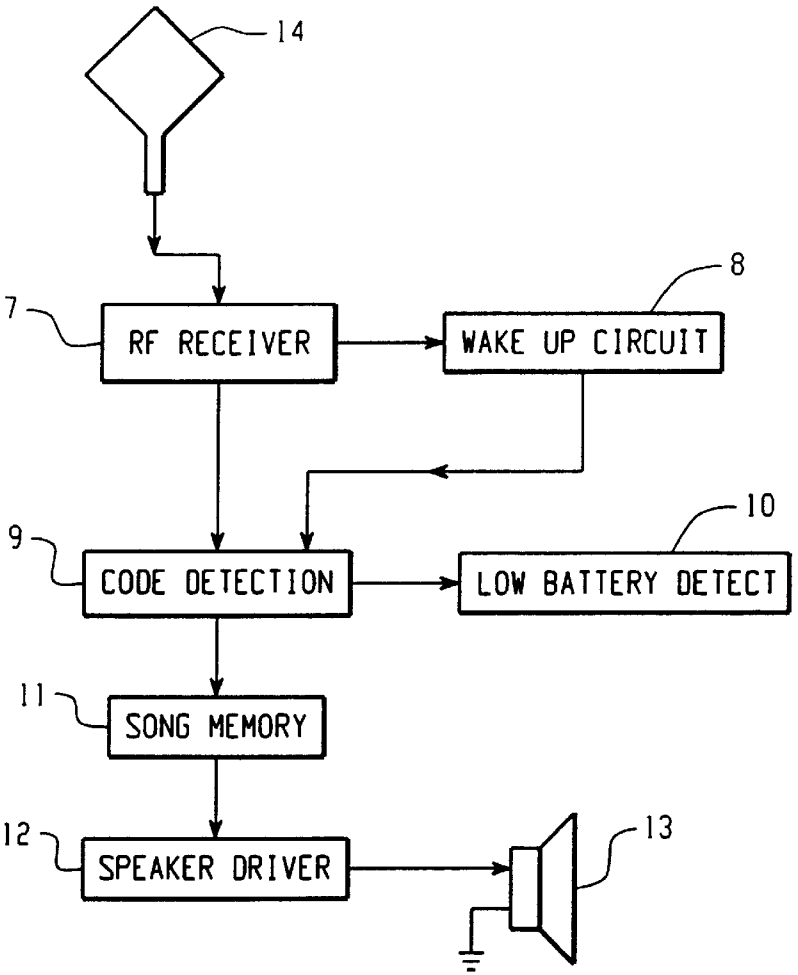
FIG. 2 is a block diagram of a preferred embodiment of a chime receiver according to the present invention.
Figure 1:
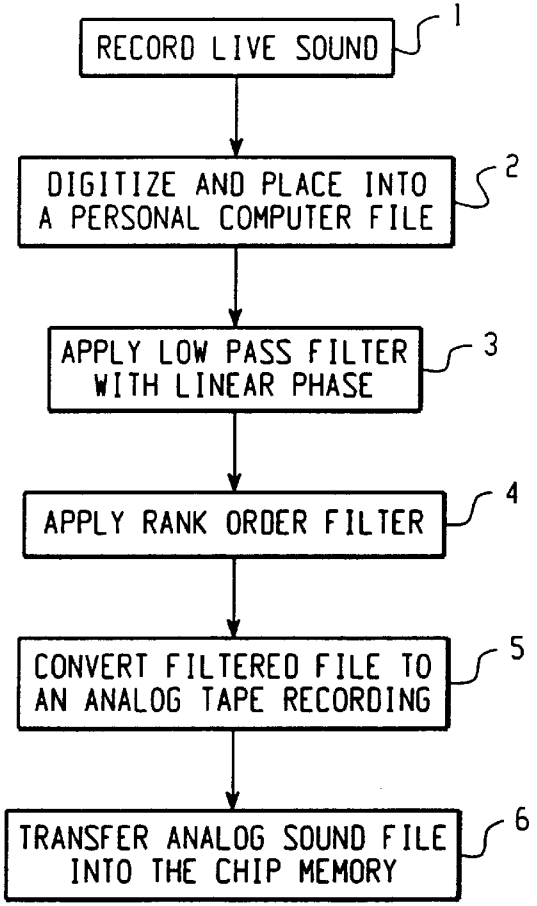
FIG. 1 is flow diagram of the method of storing a CD quality sound according to the present invention.

Referring now to the drawings, FIG. 1 sets forth a flow diagram of a preferred method of storing a CD quality sound into the memory of a door chime receiver unit and FIG. 2 sets forth a block diagram of a preferred door chime receiver unit. In the preferred method, a digital audio tape (DAT) recording of a tune such as Tubular Bells or Westminster Chimes is made in the first step of this process, the Record Live Sound 1 step. Other known methods, however, may be used such as the use of an analog audio tape recording or the use of live audio.

In the second step, Digitize and place into a personal computer file 2, the sound from step 1 is digitized, i.e., the sound is played and converted to an analog voltage representation of the sound and the analog voltage representation of the sound is converted, in turn, to a digital signal through an analog to digital conversion. The digitized sound signal is then stored in a computer readable data file.

In the preferred method, this step 2 is performed using a sound card of a personal computer. The sound card samples the recorded sound at a sampling rate of 44 kHz and produces a digital representation of the recorded sound which it stores in a *.WAV file, commonly known as a wave file. This file format is commonly used to store sounds for playback by a multimedia computer. This initial sampling rate is not critical because the file will be re-sampled in a later step but, preferably, the rate is at least as high as the second sampling rate. Next, in the preferred method, the wave file is converted into an ASCII format sample file list.

This step is not critical to the method, but allows a user to filter the data using a graphing program and allows the user to view the file with a text editor. The wave file format or any other file format, however, may also be edited and will work satisfactorily for the purposes of this invention.

In the third step, Apply Low Pass Filter with Linear Phase 3, the sound file created in step 2 is filtered using a linear low-pass-filter that reduces the bandwidth of the file but maintains the phase relationship between the frequency components. The preferred method utilizes a Bessel filter with a 3 kHz cutoff frequency.

The fourth step, Apply Rank Order Filter 4, utilizes a rank order filter, also known as a median filter, to selectively eliminate any noise spikes from the data file. This filter sets each sample to the average or trend of the surrounding samples. In the preferred method, the rank order filter had a five sample window. The combination of steps 3 and 4 combine to eliminate components of the sound that could produce noise in the sound played by the door chime receiver such as high frequency components.

In the next step of the preferred method, Convert filtered file to an analog tape recording 5, the data file from step 4 is converted back to a wave file format, the sound card is used to playback the sound, and the sound is recorded onto a tape such as an analog tape or a DAT.

Finally, in the Transfer analog sound file into the chip memory 6 step, the recorded signal from step 5 is played and applied directly to the sound memory chip which samples the sound at an 8 Khz rate. In the preferred embodiment, an ISD1420 from Integrated Storage Devices was used as the sound memory chip although any type of sound memory chip could be used.

A preferred embodiment of a receiver unit from a wireless chime unit that uses this invention will be described next. In the most basic embodiment of this invention, the wireless door chime receiver unit has a memory 11 that stores one recorded sound for playback when a doorbell button is activated. A further aspect of this invention allows the receiver unit to have a memory 11 that stores a plurality of recorded sounds. In this latter case, either a transmitter unit or the receiver unit may provide means for selection of one of those recordings.

Figure 3A:
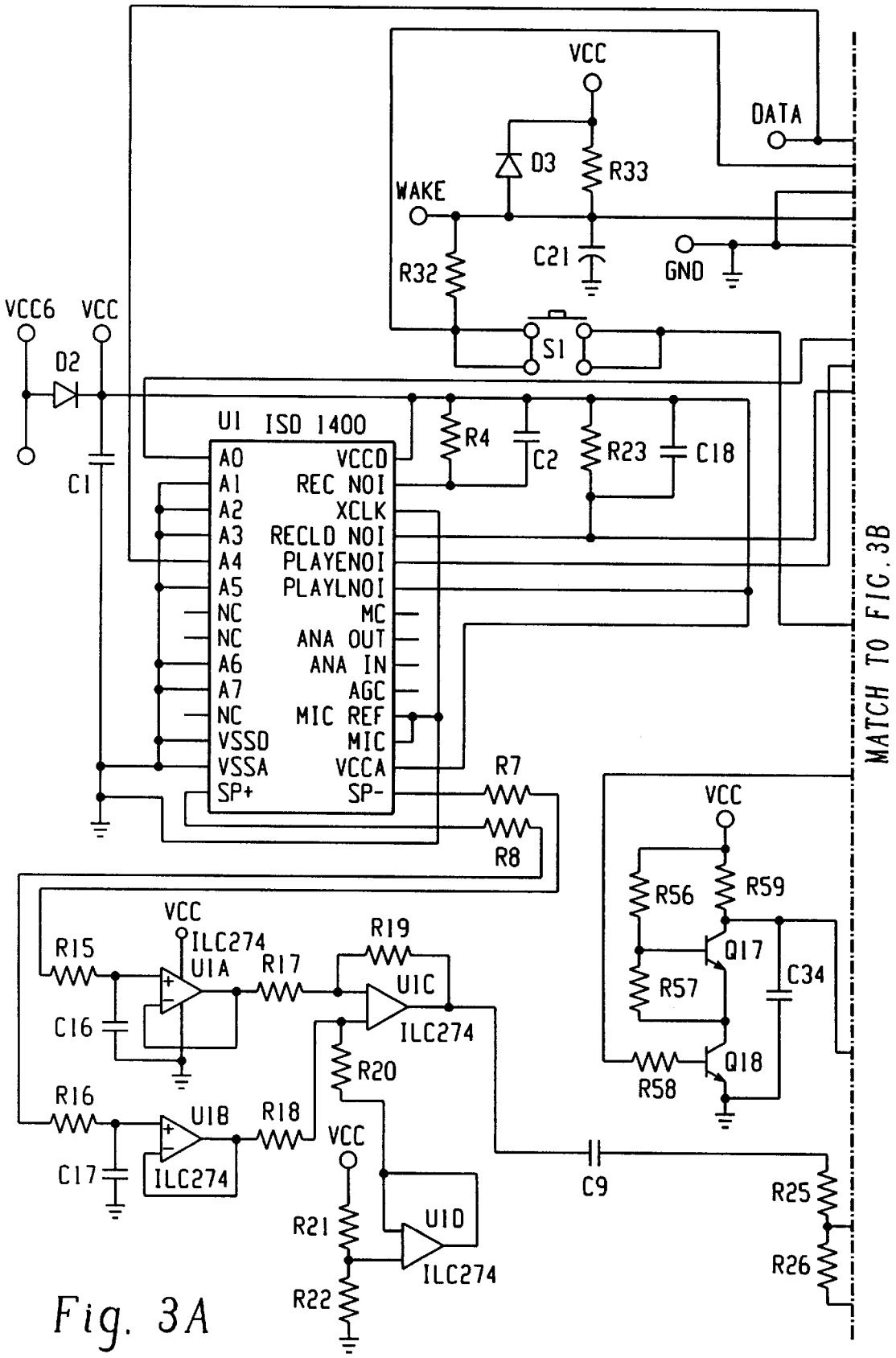
FIG. 3 is a schematic diagram of a preferred embodiment of the code detection, song memory, and sound producing portions of a preferred receiver unit according to the present invention.
Figure 3B:
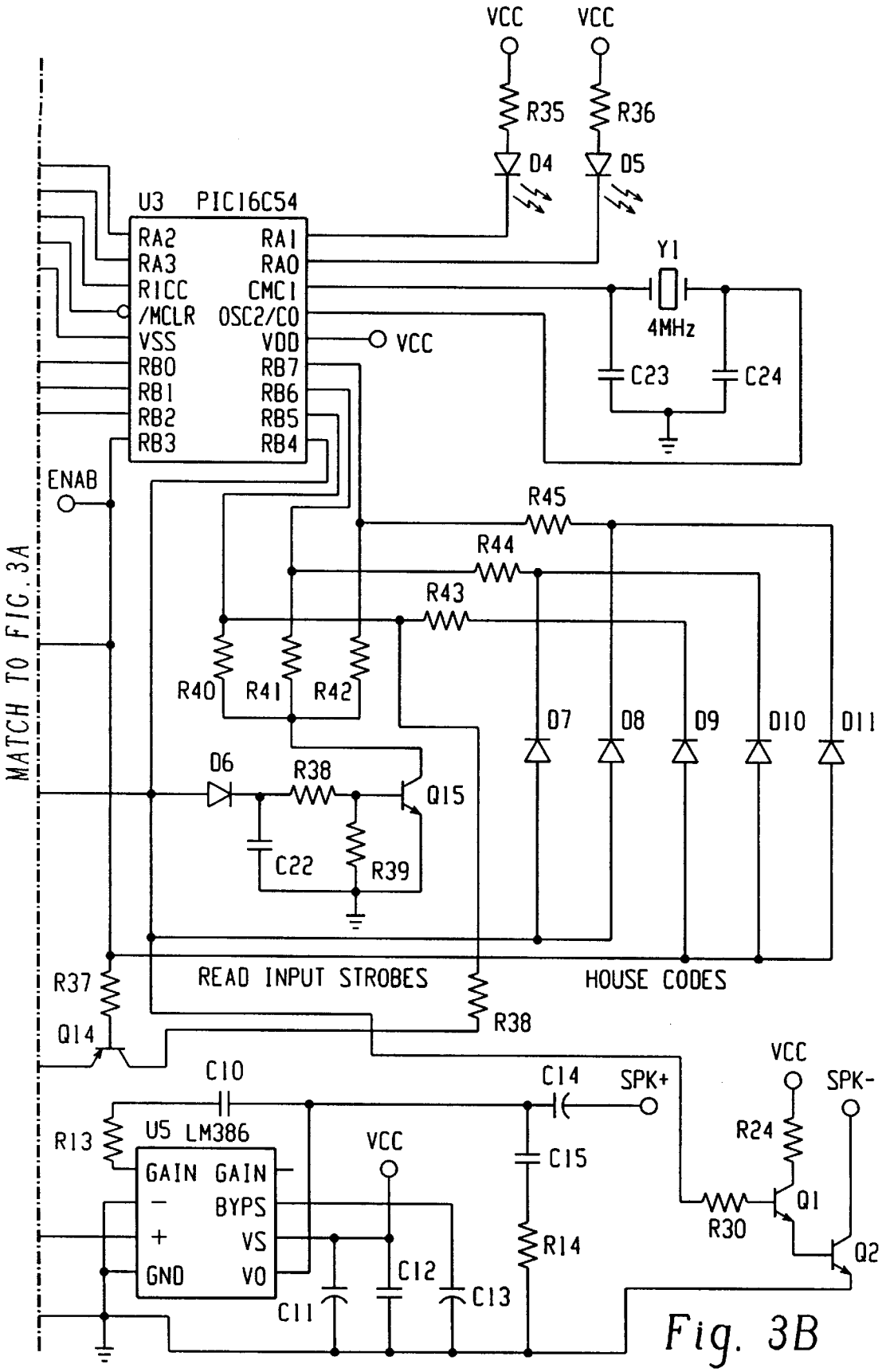
Figure 4A:
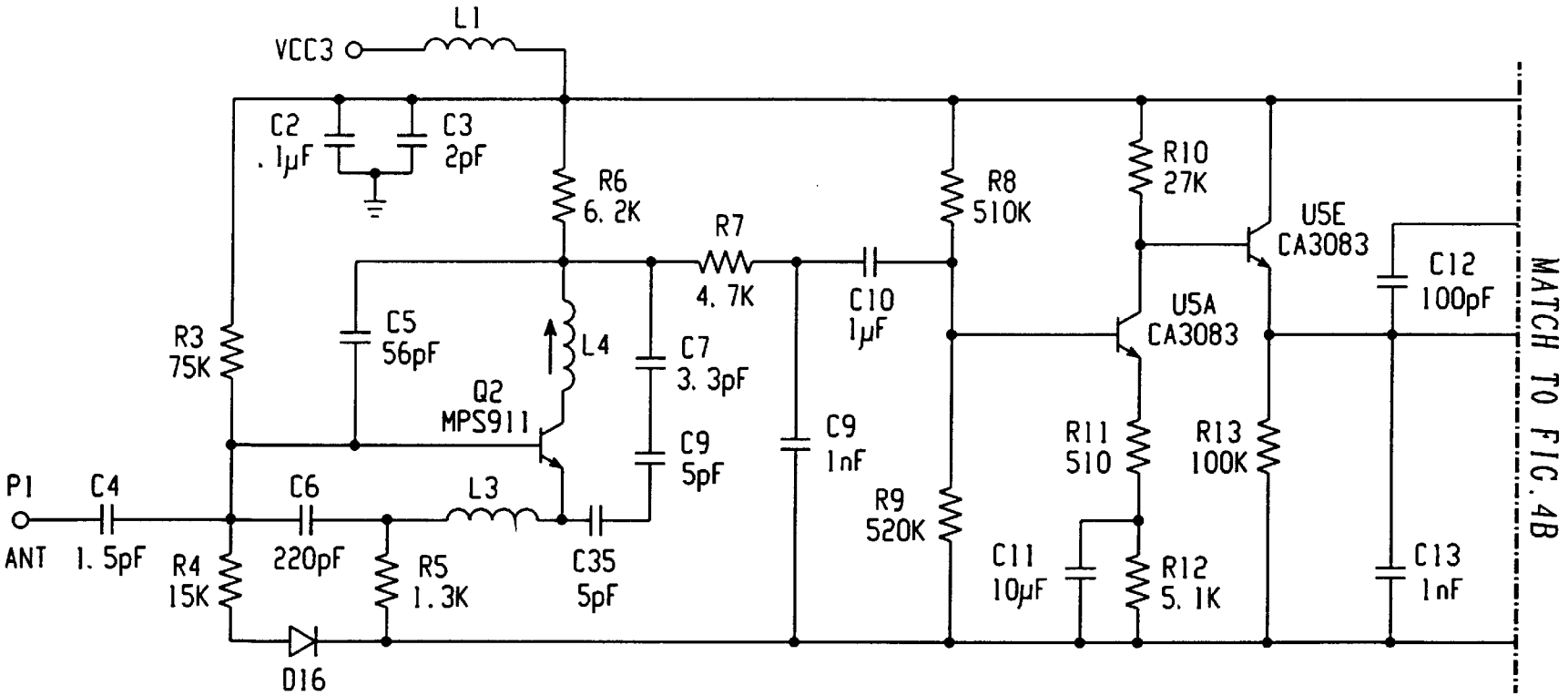
FIG. 4 is a schematic diagram of a preferred embodiment of the RF receiver and wake-up circuitry portions of a preferred receiver unit according to the present invention.
Figure 4B:
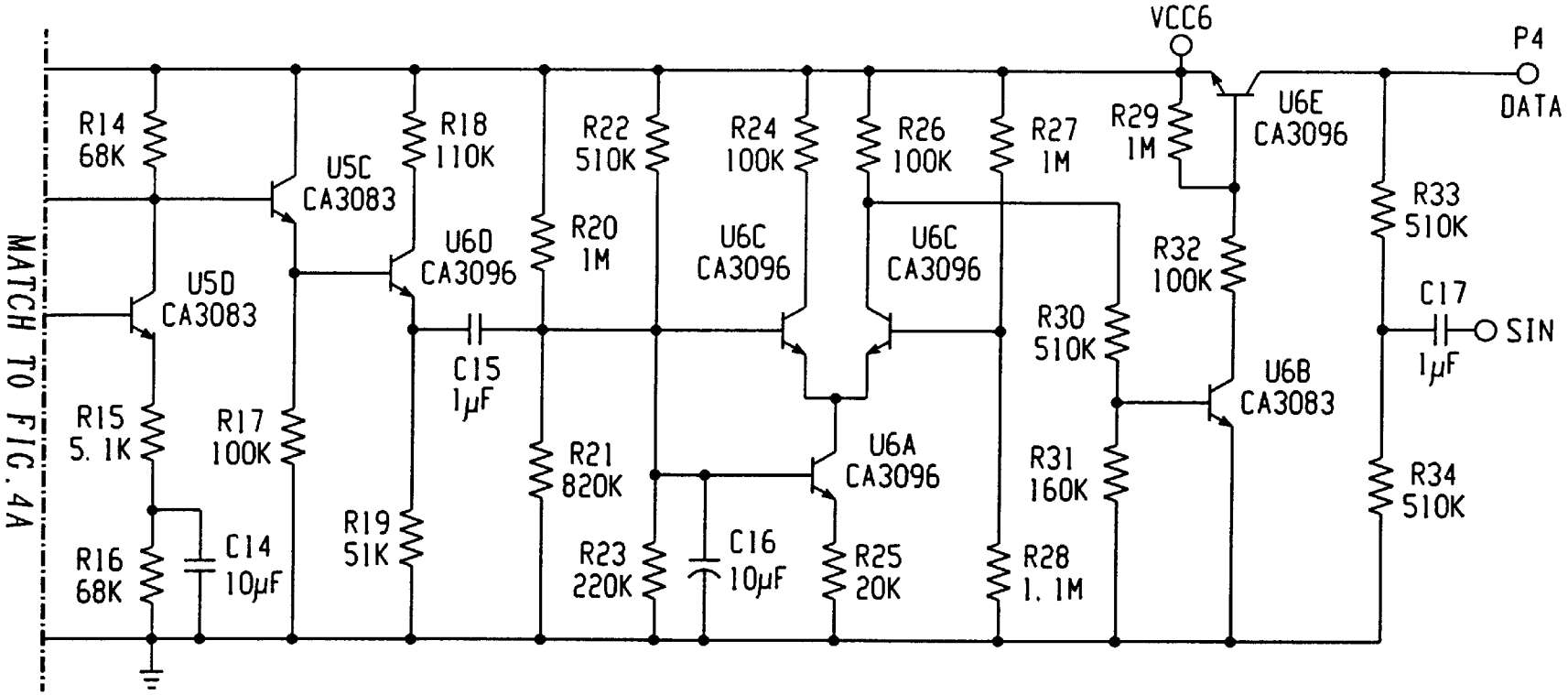
Figure 4C:
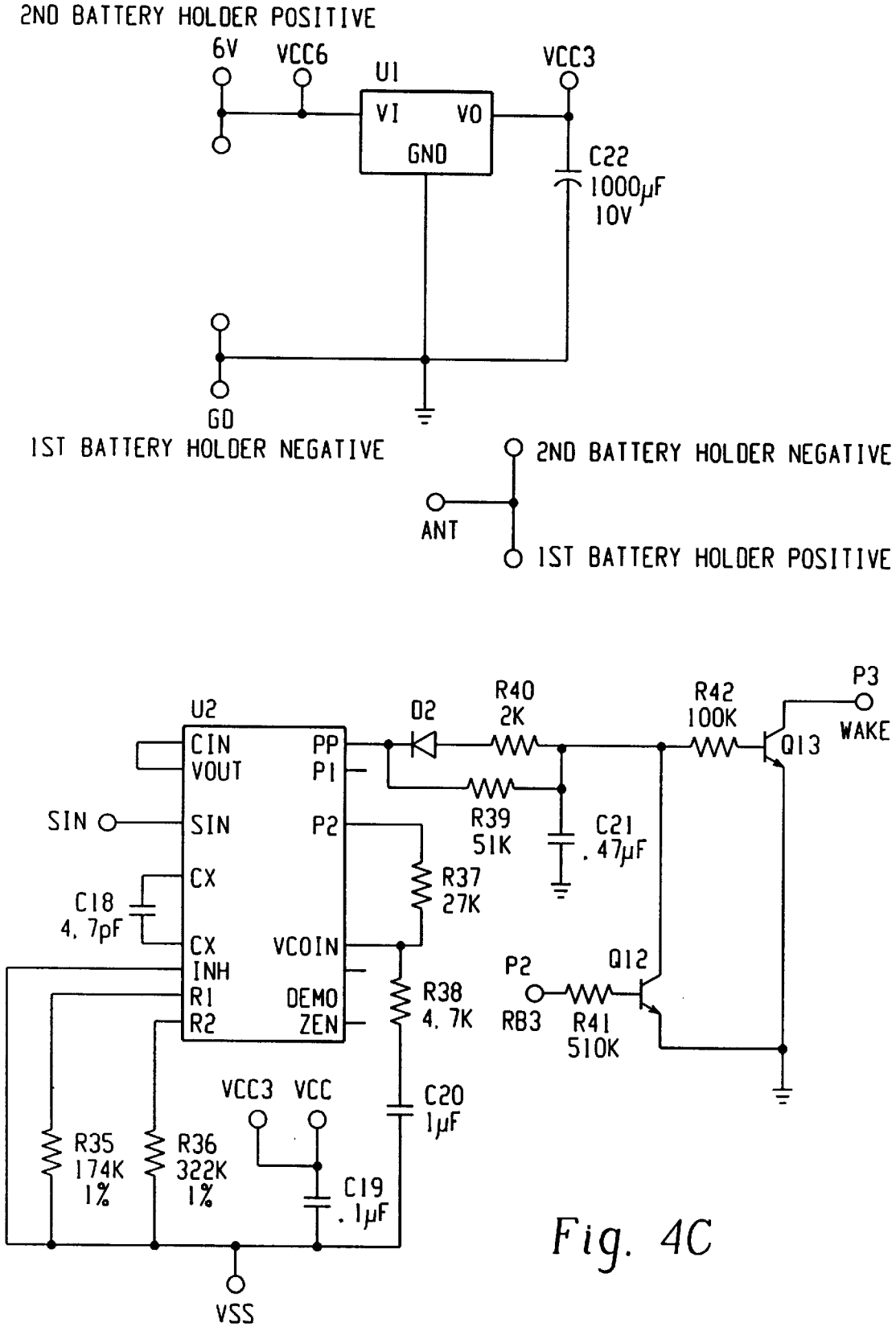

The preferred embodiment of the receiver unit of this invention is shown in block diagram form in FIG. 2 and schematic form in FIGS. 3 and 4. The transmitter unit (not shown) preferably, upon depression of a doorbell button, transmits a radio frequency signal that contains: (1) a wake-up signal, (2) a house code identifying the transmitter with a specific receiver, (3) a sound code, which indicates to the receiver which tune to play, and (4) a battery status bit, which indicates to the receiver the status of the transmitter battery.

The preferred Receiver unit, shown in block diagram form in FIG. 2, includes an RF receiver 7 for receiving the signal transmitted by the transmitter or doorbell detector (not shown), a Wake Up Circuit 8 which allows most of the circuitry in the receiver unit to go into an inactive mode to conserve power and wakes up the circuitry when a signal from the doorbell detector is received, a Code Detection Circuit 9 for decoding the code sent by the doorbell detector, a Low Battery Detect Circuit 10 for detecting and displaying to the user the status of both the doorbell detector battery and the doorbell receiver battery, a Song Memory 11 for storing the CD quality sound generated according to the method of this invention and capable of storing multiple sounds, a Speaker Driver 12 for amplifying the signal from the Song Memory 11, and a Speaker 13 for playing the song selected from the Song Memory 11.

The preferred RF Receiver 7, shown in schematic form in FIG. 4, receives AM modulated UHF signals from the Antenna 14 at P1 and produces a low frequency representation of the modulation of the received signal. The preferred RF Receiver 7 portion of the receiver unit consists of transistor Q2 and transistor arrays and is shown in the schematic of FIG. 4. The output of the RF Receiver 7 is provided at P4.

Wake Up Circuit 8, also shown on FIG. 4, allows the Code Detection Circuit 9 and the Song Memory 11 to remain in a low current "sleep" state unless a valid signal is received by the RF Receiver 7. When a valid signal is received by RF Receiver 7, a SIN output signal from RF Receiver 7 is passed to the SIN input of the Wake up Circuit 8. This wake-up signal, SIN, is received from the doorbell detector as an audio tone modulated on the RF carrier. This tone is detected by phased-locked loop (PLL) U2 of Wake Up Circuit 8, shown in FIG. 4, which causes a Wake signal to be generated at P3 which activates the Code Detection Circuit 9 and the Song Memory 11 if the tone is present.

The Code Detection 9, shown schematically in FIG. 3, compares the house code in the received signal with the house code of the receiver unit to determine whether the signal is from a transmitter that is part of the same system, and, if so, decodes the sound code to determine which tune to play from Song Memory 11. The decoding function of the Code Detection 9 is preferably performed by microprocessor U3. The preferred microprocessor U3 is a Microchip Corporation PIC16C54. Microprocessor U3 receives data from the RF Receiver 7 and compares the house code information stored within the data with the house code which is set by the user by cutting the leads of diodes D7 through D11 shown in FIG. 3. An identical number of like diodes is provided in each transmitter associated with the receiver. The preferred embodiment disclosed provides up to 32 different house codes. Use of a different number of diodes will provide a different number of available house codes. Alternatively, DIP switches, jumpers, or other well known devices may be used to allow the user to select a house code.

Low Battery Detect 10 uses microprocessor U3 of FIG. 3 to decode the low battery bit of the received data. This bit is used to indicate to the receiver unit the status of the battery within the transmitter. In this preferred embodiment, a low battery detection circuit such as the one implemented by transistors Q17 and Q18 of FIG. 3 is used both in the receiver and the transmitter to report the status of the battery in each respective unit. The Low Battery Detect 10 also utilizes the circuit formed by transistors Q17 and Q18 to verify the status of the receiver battery. Push-button switch S1 shown in FIG. 3 activates a low battery indicator using LEDs D4 and D5 shown in FIG. 3 to indicate the status of the transmitter and receiver batteries. When the user presses switch S1, the LEDs light if the corresponding battery is satisfactory. If a low battery was detected for either the transmitter or receiver, microprocessor U3 also commands Song Memory 11 to play a beep at the end of the recorded tune. In the preferred embodiment, one beep indicates that the receiver battery is low; two beeps indicates that the transmitter battery is low; and three beeps indicates that both batteries are low.

If microprocessor U3 of Code Detector 9 detects the correct house code, then the microprocessor commands Song Memory 11 to play the appropriate tune stored in memory. In the preferred embodiment, Song Memory 11 consists of sound memory chip U1, an ISD1420, which contains the memory and output drivers to produce differential analog sound signals directly at pins 14 and 15 of the chip output.

The quad op amps U4 shown in FIG. 3 provide low-pass-filtering and convert the balanced output of sound memory chip U1 to a single-ended output needed to drive audio amplifier chip U5. The circuitry associated with quad op amps U4 and audio amplifier chip U5 are conventional. The microprocessor U3 can also disable the speaker using transistors Q1 and Q2 shown in FIG. 3 when a tune is not being played to eliminate noise such as that caused when the microprocessor U3 is addressing the Song Memory 11.

Having described in detail the preferred embodiment and methods of the present invention, including preferred modes of operation, it is to be understood that this operation and apparatus could be carried out with different elements and steps. This preferred embodiment is presented only by way of example and is not meant to limit the scope of the present invention which is defined and limited only by the following claims.

What is claimed:

1. A wireless door chime system comprising:

a door chime receiver that is operative to receive an indication that a doorbell button has been actuated;

a song detector having a communication path with the door chime receiver and that is operative to provide a command signal to cause the door chime system to play a high quality musical sound after notification by the door chime receiver that the doorbell button has been actuated;

a sound memory that receives the command from the song detector and that upon receipt of the command outputs a previously stored musical signal that represents a high quality musical sound, the stored musical signal having been generated from a first musical sound that was digitized, filtered through the application of a digital low-pass filter, filtered through the application of a rank order filter, and converted to a second musical sound before being stored in the sound memory; and sound producing means for converting the stored musical signal from the sound memory into an audible sound.

2. The door chime system according to claim 1 further comprising a door chime detector that is electrically coupled to the doorbell button and that transmits an actuation signal to the door chime receiver that is the indication that the doorbell button has been actuated.

3. The door chime system according to claim 2 wherein the actuation signal from the door chime detector is an RF signal and the door chime receiver is an RF receiver.

4. The door chime system according to claim 2 further comprising a wake-up circuit that generates a wake-up signal upon receipt of the actuation signal by the door chime receiver.

5. The door chime system according to claim 4 wherein the song detector has an active mode and a sleep mode, the song detector switching from the sleep mode to the active mode in response to receiving the wake-up signal from the wake-up circuit.

6. The door chime system according to claim 1 wherein the sound memory stores a plurality of musical signals wherein each musical signal represents a different high quality musical sound, the musical signal that is outputted from the sound memory is selected based upon the command from the music detector.

7. The door chime system according to claim 1 wherein the sound producing means comprises a speaker.

8. A wireless door chime system comprising:

a door chime receiver that is operative to receive an indication that a doorbell button has been actuated;

a sound memory that, in response to receipt by the door chime receiver of the indication that the doorbell button has been actuated, is operative to output a previously stored musical signal that represents a high quality musical sound, the stored musical signal having been generated from a first musical sound that was digitized, filtered through the application of a digital low-pass filter, filtered through the application of a rank order filter, and converted to a second musical sound before being stored in the sound memory; and sound producing means for converting the stored musical signal from the sound memory into an audible sound.

9. The door chime system according to claim 8 wherein the first musical sound was digitized using the steps of:

converting the first musical sound into an analog voltage signal;

converting the analog voltage signal into a digital signal; and storing the digital signal in a computer file.

10. The door chime system according to claim 8 wherein the digital low-pass filter comprises a linear phase low-pass filter.

11. The door chime system according to claim 8 wherein the low-pass-filter comprises a Bessel filter.

12. The door chime system according to claim 8 wherein the filtered, digitized first musical sound is converted to the second musical sound using the steps of:

converting the filtered digitized sound signal to an analog voltage signal; and converting the analog voltage signal to the second musical sound.

13. The door chime system according to claim 8 wherein said first musical sound is a recorded sound.

14. The door chime system according to claim 8 wherein said first musical sound is a live sound.

15. The door chime system according to claim 9 wherein the step of converting the analog voltage signal into a digital signal is performed using a sound card of a personal computer.

16. The door chime system according to claim 8 wherein the first musical sound is a musical sound selected from a group of sounds comprising: Tubular Bells and Westminister Chimes.

17. The door chime system according to claim 8 wherein the sound memory stores a plurality of musical signals wherein each musical signal represents a different high quality musical sound.

18. The door chime system according to claim 8 wherein the sound memory comprises an analog sound memory integrated circuit.

* * * * *

UNITED STATES PATENT AND TRADEMARK OFFICE

CERTIFICATE OF CORRECTION

PATENT NO. : 6,545,595 B1
DATED : April 8, 2003
INVENTOR(S) : Xydis

It is certified that error appears in the above-identified patent and that said Letters Patent is hereby corrected as shown below:

Column 6,
Line 46, delete “9” and insert -- 8 --.

Signed and Sealed this

Fifth Day of August, 2003

JAMES E. ROGAN
*Director of the United States Patent and Trademark Office*